US010233406B2

(12) United States Patent
Araujo Barreto et al.

(10) Patent No.: US 10,233,406 B2
(45) Date of Patent: Mar. 19, 2019

(54) NONIONIC SURFACTANT COMPOSITION AND SURFACE CLEANING FORMULATION

(71) Applicant: Oxiteno S.A. Industria e Comercio, Sao Paulo (BR)

(72) Inventors: Elvis Araujo Barreto, Sao Paulo (BR); Rafaela Pepineli, Sao Paulo (BR); Rafael Fernando De Santi Ungarato, Sao Paulo (BR)

(73) Assignee: Oxiteno S.A. Industria e Comercio, Sao Paulo (BR)

( * ) Notice: Subject to any disclaimer, the term of this patent is extended or adjusted under 35 U.S.C. 154(b) by 0 days.

(21) Appl. No.: 15/388,667

(22) Filed: Dec. 22, 2016

(65) Prior Publication Data

US 2018/0179466 A1 Jun. 28, 2018

(51) Int. Cl.

| | |
|---|---|
| ***C11D 1/62*** | (2006.01) |
| ***C11D 1/66*** | (2006.01) |
| ***C11D 1/72*** | (2006.01) |
| ***C11D 3/20*** | (2006.01) |
| ***C11D 3/30*** | (2006.01) |
| ***C11D 3/33*** | (2006.01) |

(52) U.S. Cl.

CPC ..... *C11D 1/66* (2013.01); *C11D 1/62* (2013.01); *C11D 3/2031* (2013.01); *C11D 3/2048* (2013.01); *C11D 3/30* (2013.01); *C11D 3/33* (2013.01)

(58) Field of Classification Search

CPC .... C11D 1/62; C11D 1/66; C11D 1/72; C11D 3/20; C11D 3/30

See application file for complete search history.

(56) References Cited

U.S. PATENT DOCUMENTS 7,530,361 B2 * 5/2009 Killeen ..... C11D 1/825 134/25.2

FOREIGN PATENT DOCUMENTS

| | | | | |
|---|---|---|---|---|
| EP | 2 264 138 A1 | | 12/2010 | |
| WO | WO 96/18711 A1 | | 6/1996 | |
| WO | WO 2014/085271 | * | 6/2014 | ..... C11D 1/68 |
| WO | WO 2014/085271 A1 | | 6/2014 | |

* cited by examiner

*Primary Examiner* — Brian P Mruk
(74) *Attorney, Agent, or Firm* — Crowell & Moring LLP

(57) ABSTRACT

The present invention describes a composition of nonionic surfactants comprising a mixture of Guerbet alcohols and natural fatty alcohols with different ethoxylation gradients for producing a surface cleaning formulation. Preferably, the natural fatty alcohols are the 4 EO and 6 EO lauryl alcohols. This cleaning formulation has the advantage of being more environmental-friendly and providing a similar efficiency of formulations from fossil origin.

10 Claims, No Drawings

NONIONIC SURFACTANT COMPOSITION AND SURFACE CLEANING FORMULATION

FIELD OF THE INVENTION

The instant invention relates to non-ionic surfactant compositions comprising at least one ethoxylated natural fatty acid and at least one Guerbet alcohol with different degrees of ethoxylation to produce surface cleaning formulations.

BACKGROUND OF THE INVENTION

The growing concern of society with sustainability has intensified the control of products that are harmful to the environment. Therefore, products containing ethoxylated alkylphenols, widely used in cleaning agents and household detergents, have been subject to severe restrictions and prohibitions in many parts of the world over the years.

Problems related to the preservation of the environment, biodegradability and harmful effects on human health have been reported, motivating the substitution of ethoxylated alkylphenols by less harmful and aggressive compounds.

Biodegradable products are those that tend to degrade naturally, that is, they have natural conditions allowing them to incorporate again to the soil.

In this regard, ethoxylated Guerbet alcohol-based surfactants are indicated as substitutes for ethoxylated alkylphenols. These surfactants have excellent wetting power, emulsifying action, low odor and excellent solubilization of oils and fats.

Ethoxylation is an industrial process in which ethylene oxide is added to fatty alcohols to obtain detergent properties. In an industrial ethoxylation, an alcohol is treated with ethylene oxide and potassium hydroxide (KOH), which acts as a catalyst. The reactor is pressurized with nitrogen and heated at approximately 150° C.:

$$ROH+nC_2H_4O \rightarrow R(OC_2H_4)_nOH$$

A product distribution is obtained. These products are important non-ionic surfactants, since they have both lipophilic "tails" (R in the equation) and a relatively polar group in the "head" ($(OC_2H_4)_nOH$ in the example above). The amount of ethylene oxide and the reaction time determine the degree of ethoxylation, which in turn determines the properties of the ethoxylated surfactant. Traditionally, alcohols are obtained by hydrogenation of fatty acids, and also by "oxo alcohols" obtained via hydroformylation.

Guerbet Alcohol

Guerbet alcohols have been known since 1890 when Marcel Guerbet first synthesized such compounds. The reaction that bears its name occurs at high temperatures in the presence of alkaline catalysts. The global reaction can be renresented by the following equation:

$$2(RCH)_2CH_2OH \xrightarrow[catalisador]{\Delta} R_2CHCH_2OH$$

The product is an alcohol with essentially twice the molecular weight. The reaction proceeds by a number of sequential steps that are: (1) oxidation of the alcohol to aldehyde; (2) aldehyde aldol condensation; (3) dehydration of the aldol product; and (4) hydrogenation of the allelic aldehyde.

Since they are branched and of high molecular weight, Guerbet alcohols have the following characteristics:

have low irritation potential;

are liquid at extremely low temperatures;

have low volatility;

are reactive and can be used to make many derivatives;

are good lubricants.

The prior art provides some options for using Guerbet alcohols and Guerbet alcohols mixtures with other alcohols for cleaning formulations. Among them, it is possible to highlight the three documents mentioned below.

Document No. EP 2 264 138 A1 discloses a dishwashing detergent composition comprising a chelator and a surfactant system. The surfactant system is contained in an amount ranging from 18% to 80% by weight of the total composition and comprises nonionic surfactants such as C8-C22 aliphatic alcohols and branched alcohols such as, for instance, Guerbet alcohols.

Document No. WO 96/18711 A1 describes a cleaning composition for hard surfaces comprising surfactants derived from highly ethoxylated Guerbet alcohols with from 7 to 30 moles of ethylene oxide per mole of alcohol. It is further described that nonionic and non-Guerbet surfactants are contained in an amount ranging from 0.5% to 10% of the cleaning composition.

Document No. WO 2014/085271 A1 relates to a laundry detergent using an APE (alkylhenol ethoxylate)-free surfactant comprising from 40% to 95% by weight of a mixture of nonionic surfactants, wherein the mixture comprises an ethoxylated linear fatty alcohol, an ethoxylated branched fatty alcohol and an ethylene oxide-propylene oxide copolymer.

Currently, the most commonly used nonionic surfactants in surface cleaning formulations are ethoxylated linear alcohols of C9-C11 chain size of strictly petrochemical origin, produced from olefins derived from ethene.

Thus, we find that the technique still requires a nonionic surfactant composition to be used in environmentally friendly surface cleaning formulations using natural alcohols.

SUMMARY OF THE INVENTION

In a broad sense, the invention describes nonionic surfactant compositions prepared from a mixture of Guerbet alcohols and ethoxylated natural alcohols.

The surface cleaning formulation prepared with the nonionic surfactant composition according to the present invention exhibits similar efficiency and performance as those prepared from nonionic surfactants of fossil origin with the advantage of being more environmentally friendly.

DETAILED DESCRIPTION OF THE INVENTION

The present invention relates to a composition of nonionic surfactants comprising a mixture of Guerbet alcohols and natural fatty alcohols with different ethoxylation gradients for the production of a surface cleaning formulation. This cleaning formulation has the advantage of being more environmental-friendly and providing a similar efficiency of formulations from fossil origin.

More precisely, the present invention relates to a composition of nonionic surfactants comprising at least one Guerbet alcohol having a degree of ethoxylation between 6 and 12 moles of ethylene oxide (i.e. 6 and 12 EO), and at least one lauryl alcohol with a degree of ethoxylation between 2 and 8 moles of ethylene oxide (i.e. 2 and 8 EO).

The Guerbet alcohols are contained in the composition in a concentration ranging from 30 and 80% by weight, while the lauryl alcohols represent from 20 to 70% by weight of the nonionic surfactant composition. However, preferably no alcohol should be contained alone in the composition in an amount greater than 40% by weight. In other words, since in the surfactant composition according to the present invention there are Guerbet alcohols in amount higher than 40% by weight, we should consider to employ a mixture of Guerbet alcohols having different degrees of ethoxylation, so that each of them, individually, does not exceed 40% by weight of the composition, thus ensuring the necessary balance. The same reasoning applies to lauryl alcohols in the preferred embodiment of the invention.

In a preferred embodiment, the alcohols are selected from the group consisting of 8 EO Guerbet alcohol, 10 EO Guerbet alcohol, 4 EO lauryl alcohol and 6 EO lauryl alcohol, wherein the lauryl alcohol is a natural fatty alcohol. The lauryl alcohol is derived from palm fruit or coconut oil and is ethoxylated by the process known in the art.

Considering this preferred embodiment, the nonionic surfactant composition comprises from 0 to 40% of 8EO Guerbet alcohol and from 0 to 40% of 10 EO Guerbet alcohol, wherein at least one ethoxylated Guerbet alcohol is present in the composition. The ethoxylated Guerbet alcohol of the present invention is prepared from 2-propyl-1-heptanol.

Said composition is in the form of a clear nonionic liquid at a temperature above 40° C., with low foam, alkaline pH and water solubility. Whether combined or not with other surfactants, the described composition is compatible with the main ingredients used in cleaning products, demonstrating its ease of application and benefits, such as improving the stability and higher performance of these formulations.

A surface cleaning formulation can be prepared from this surfactant composition, which should ideally further comprise an active cationic surfactant, a salt of sequestering agent, a coadjuvant buffer and a solvent.

Preferably, the active cationic surfactant is benzalkonium chloride, the salt of the sequestering agent is ethylenediamine tetraacetic acid (EDTA), the auxiliary buffer is monoethanolamine and the solvent is water.

According to the present invention, the nonionic surfactant composition is contained in an amount ranging between 0.5 and 3% by weight of the cleaning formulation.

Comparative Tests

To prove the efficiency of the present nonionic surfactant composition, tests were carried out to evaluate the cleaning between several mixtures of ethoxylated alcohols at different concentrations and compare them with two nonionic surfactants of fossil origin produced from $C_9$-$C_{11}$ alcohols with a degree of ethoxylation ranging from 6 to 8 EO commonly used in surface cleaning formulations.

Table 1 shows the input amounts of the surface cleaning formulation used in the test.

TABLE 1

Surface cleaning formulation

| Input | Mass percent (%) |
|---|---|
| Water | 98.4 |
| Nonionic surfactant composition | 1.0 |
| Monoethanolamine | 0.3 |
| Benzalkonium Chloride | 0.2 |
| EDTA | 0.1 |

Table 2 below shows tested nonionic surfactant compositions and their mass amounts.

TABLE 2

Tested nonionic surfactant compositions

| | 8EO Guerbet | 10EO Guerbet | 4E0 Lauryl alcohol | 6E0 Lauryl alcohol | 91 6EO ® Neodol | 91 8EO ® Neodol |
|---|---|---|---|---|---|---|
| 1 | 0.00 | 0.00 | 1.00 | 0.00 | 0.00 | 0.00 |
| 2 | 0.00 | 0.00 | 0.00 | 1.00 | 0.00 | 0.00 |
| 3 | 0.50 | 0.00 | 0.00 | 0.50 | 0.00 | 0.00 |
| 4 | 0.00 | 0.00 | 0.50 | 0.50 | 0.00 | 0.00 |
| 5 | 0.25 | 0.25 | 0.25 | 0.25 | 0.00 | 0.00 |
| 6 | 0.00 | 0.00 | 0.00 | 0.00 | 1.00 | 0.00 |
| 7 | 0.00 | 0.00 | 0.00 | 0.00 | 0.00 | 1.00 |

It is to be noted that compositions 6 and 7 refer to nonionic surfactant compositions of fossil origin, commonly used in surface cleaning formulations (Comparative Examples).

The test was carried out by applying a known amount of standard dirt to a vinyl surface. After 24 hours, the dirty surface was scanned. Subsequently, dirt removal was carried out by each of the surface cleaning formulations through the equipment called Scrub Test.

For the analysis of the results, the results were read using the scanned image of the plate. Cleaning values close to zero would indicate that the plate would be black, that is, as dirty as possible, while cleaning values close to 100% indicate that the plate is completely clean.

Table 3 shows the results of each one of the tested formulations.

TABLE 3

Results of the tested formulations

| Composition | Cleaning % |
|---|---|
| 1 | 51.1 |
| 2 | 59.9 |
| 3 | 52.7 |
| 4 | 48.8 |
| 5 | 82.0 |
| 6 | 80.0 |
| 7 | 72.5 |

First of all, upon observing Table 3, let use stress that the cleaning formulation comprising the nonionic lauryl alcohol surfactant alone has an intermediate cleaning result (see compositions 1, 2 and 4).

Upon promoting the mixture of a lauryl alcohol with a Guerbet alcohol in a 50:50 ratio, as observed in composition 3 above, this intermediate result is still maintained.

However, upon adding ethoxylated lauryl alcohols to a nonionic surfactant composition comprising a mixture of Guerbet alcohols at a given ratio, according to the present invention, the cleaning result is improved and enhanced, as can be seen in composition 5. Thus, we can state that there was a synergistic and unexpected effect with these mixtures.

Furthermore, we should note that the inventive blend of Guerbet and lauryl alcohols for use in surface cleaning formulations exhibits cleaning results very similar to compositions comprising nonionic surfactants of fossil origin, with the great advantage of being more environmental-friendly.

According to its characteristics, said ethoxylated alcohol mixture exhibits high cleaning performance as an ingredient with high dirt removal, and for application in surface cleaners.

While the present invention has been widely described, it is obvious to those skilled in the art that various changes and modifications may be performed to improve the design without such changes being outside the scope of the invention.

The invention claimed is:

1. A nonionic surfactant composition comprising:

(a) two or more Guerbet alcohols having a degree of ethoxylation ranging between 6 and 12 EO, and (b) at least one natural lauryl alcohol having a degree of ethoxylation between 2 and 8 EO, wherein the two or more Guerbet alcohols are contained in a concentration ranging from 30 and 80% by weight, and wherein the at least one lauryl alcohol represents from 20 to 70% by weight of the composition.

2. The nonionic surfactant composition, according to claim 1, wherein no alcohol is contained in the composition alone in amount higher than 40% by weight.

3. The nonionic surfactant composition, according to claim 1, wherein the two or more Guerbet alcohols are selected from the group consisting of 8 EO Guerbet alcohols, 10 EO Guerbet alcohols, and mixtures thereof.

4. The nonionic surfactant composition, according to claim 1, wherein the at least one lauryl alcohol is selected from the group consisting of 4 EO lauryl alcohols, 6 EO lauryl alcohols, and mixtures thereof.

5. The nonionic surfactant composition, according to claim 1, wherein the nonionic surfactant composition comprises from 25 to 35% of 8 EO Guerbet alcohol, from 25 to 35% of 10 EO Guerbet alcohol, and from 30% to 50% of at least one 4 and/or 6 EO lauryl alcohol.

6. The nonionic surfactant composition, according to claim 1, wherein the ethoxylated Guerbet alcohol is prepared from 2-propyl-1-heptanol.

7. A surface cleaning formulation comprising the nonionic surfactant composition as defined in claim 1.

8. The surface cleaning formulation, according to claim 7, wherein the nonionic surfactant composition is contained in an amount ranging between 0.5 and 3% by weight of the cleaning formulation.

9. The surface cleaning formulation, according to claim 7, further comprising an active cationic surfactant, a salt of sequestering agent, a coadjuvant buffer and a solvent.

10. The surface cleaning formulation, according to claim 9, wherein the surface cleaning formulation comprises water, ethylenediamine tetraacetic acid (EDTA), monoethanolamine and benzalkonium chloride.

* * * * *